United States Patent [19]

Brueske

[11] 4,421,242

[45] Dec. 20, 1983

[54] PANEL LOCATOR

[75] Inventor: Ralph H. Brueske, Kansas City, Mo.

[73] Assignee: Butler Manufacturing Company, Kansas City, Mo.

[21] Appl. No.: 353,874

[22] Filed: Mar. 2, 1982

Related U.S. Application Data

[63] Continuation-in-part of Ser. No. 131,871, Mar. 19, 1980, abandoned.

[51] Int. Cl.[3] ..... E04D 15/00; B61D 1/00; B66C 23/02

[52] U.S. Cl. ..... 212/218; 212/244; 212/254; 212/195; 105/163 R; 105/177; 104/245; 414/10; 52/749

[58] Field of Search ..... 212/195, 211, 218, 223, 212/244, 254, 265; 187/2; 105/177, 163; 104/245; 52/749; 414/10

[56] References Cited

U.S. PATENT DOCUMENTS

| | | | |
|---|---|---|---|
| 1,653,432 | 12/1927 | Hansen | 212/254 |
| 2,686,606 | 8/1954 | Smith | 212/223 |
| 2,759,604 | 8/1956 | Carpenter | 212/253 |
| 2,989,197 | 6/1961 | Werner et al. | 212/244 |
| 3,408,950 | 4/1968 | Puhringer | 105/163 R |
| 3,450,062 | 6/1969 | Pradon | 105/163 R |
| 3,734,302 | 5/1973 | Dorand | 212/254 |
| 4,003,479 | 1/1977 | Reyer | 212/244 |
| 4,050,587 | 9/1977 | Moen | 212/244 |
| 4,078,355 | 3/1978 | Clemensen | 52/749 |
| 4,222,212 | 9/1980 | Alderman | 52/749 |

FOREIGN PATENT DOCUMENTS

| | | | |
|---|---|---|---|
| 134355 | of 0000 | Fed. Rep. of Germany | 212/244 |
| 403422 | 10/1924 | Fed. Rep. of Germany | 212/254 |
| 2093 | 1/1827 | France | 212/254 |
| 1020150 | 6/1950 | France | 212/244 |
| 1418163 | 10/1965 | France | 212/244 |
| 6503004 | 9/1966 | Netherlands | 212/223 |

*Primary Examiner*—Galen L. Barefoot
*Assistant Examiner*—R. B. Johnson
*Attorney, Agent, or Firm*—Shoemaker and Mattare, Ltd.

[57] ABSTRACT

A panel locator for moving bundles of panels from one place to another on a roof includes a base section movably mounted on roof purlins, and a tower section extending upwardly from the base section, and a boom section pivotably mounted on the tower section. The locator has the capability for maintaining a level orientation on a sloped roof and can change direction of movement from along the roof length to up and down the slope.

16 Claims, 9 Drawing Figures

PANEL LOCATOR

BACKGROUND OF THE INVENTION

The present application is a continuation-in-part of application Ser. No. 131,871, filed Mar. 19, 1980 now abandoned.

The present invention relates in general to the building arts, and, more particularly, to devices used in building construction.

Placing insulation on any type of building in today's construction market requires skill and good workmanship to achieve the full value of the insulation for that structure.

A device developed by the assignee of the present invention is known as "ROLL RUNNER" ®.

The ROLL RUNNER is a series of steel stands containing large spools of roof insulation that are connected by a common platform on wheels rolled across a pre-engineered steel roof framing. This platform is moved across the roof steel system by a workman turning a handle on a winch. As the ROLL RUNNER moves across the roof steel, it dispenses insulation to the roof steel, and a roof panel is placed on the insulation and fastened to the roof framing.

Before the innovation of ROLL RUNNER, workmen would place bundles of roof paneling on the roof system during roof steel erection. This method was called "pre-loading a roof". This would allow a workman to be able to get the roof panels from a pre-located crate of panels as he was placing roof panels on the insulation which he unrolled by hand to the roof steel.

With this new method of placing insulation with a ROLL RUNNER, these bundles of pre-loaded roof panels are in the path of the ROLL RUNNER platform. Thus, there is need for a means for moving bundles of panels over the ROLL RUNNER platform to a location which is easily accessible to workmen placing panels on insulation.

SUMMARY OF THE INVENTION

The device embodying the teachings of the present invention includes means for hoisting panel bundles and moving those bundles from one place to another while those panels are suspended.

The device includes a panel locator formed of a lightweight frame which can roll on pre-engineered roof framing steel in any direction, up or down the slope of the building, or the length of the building, by simply pushing the locator which is on wheels.

To change the direction of the locator, a transfer track can be clamped from up to down slope direction to the building length.

The locator is made up of a pipe and hub system, which makes it easy to assemble and transport from job to job, and has leveling means for maintaining the device level on a sloped roof. This locator can also be used on the eave line of a pre-engineered building to pick up tall and heavy metal panels.

The panel locator embodying the teachings of the present invention has the following advantages over the prior art:

(a) it travels on roof panel support purlin systems, and does not need additional structural support to roll on or lift from such systems;

(b) it is lightweight in construction, which enables workmen to roof assemble, and move about the purlin system with ease; and (c) it can adjust mechanically to roof pitch.

Thus, the panel locator disclosed herein is lightweight in construction, easily movable, adjusts to roof pitch, rolls on a roof purlin system, moves prelocated roof panel bundles over ROLL RUNNER devices, thus allowing the ROLL RUNNER machine to move forward, and reduces the work required to place roof panels in position which are located behind the ROLL RUNNER machine.

OBJECTS OF THE INVENTION

It is a main object of the present invention to move bundles of panels from one place to another on a roof in an easy and expeditious manner.

It is another object of the present invention to move a bundle of panels over a ROLL RUNNER platform to easy access of workmen placing panels on roof insulation.

These together with other objects and advantages which will become subsequently apparent reside in the details of construction and operation as more fully hereinafter described and claimed, reference bieng had to the accompanying drawings forming part hereof, wherein like reference numerals refer to like parts throughout.

DETAILED DESCRIPTION OF THE INVENTION

Figure 1:
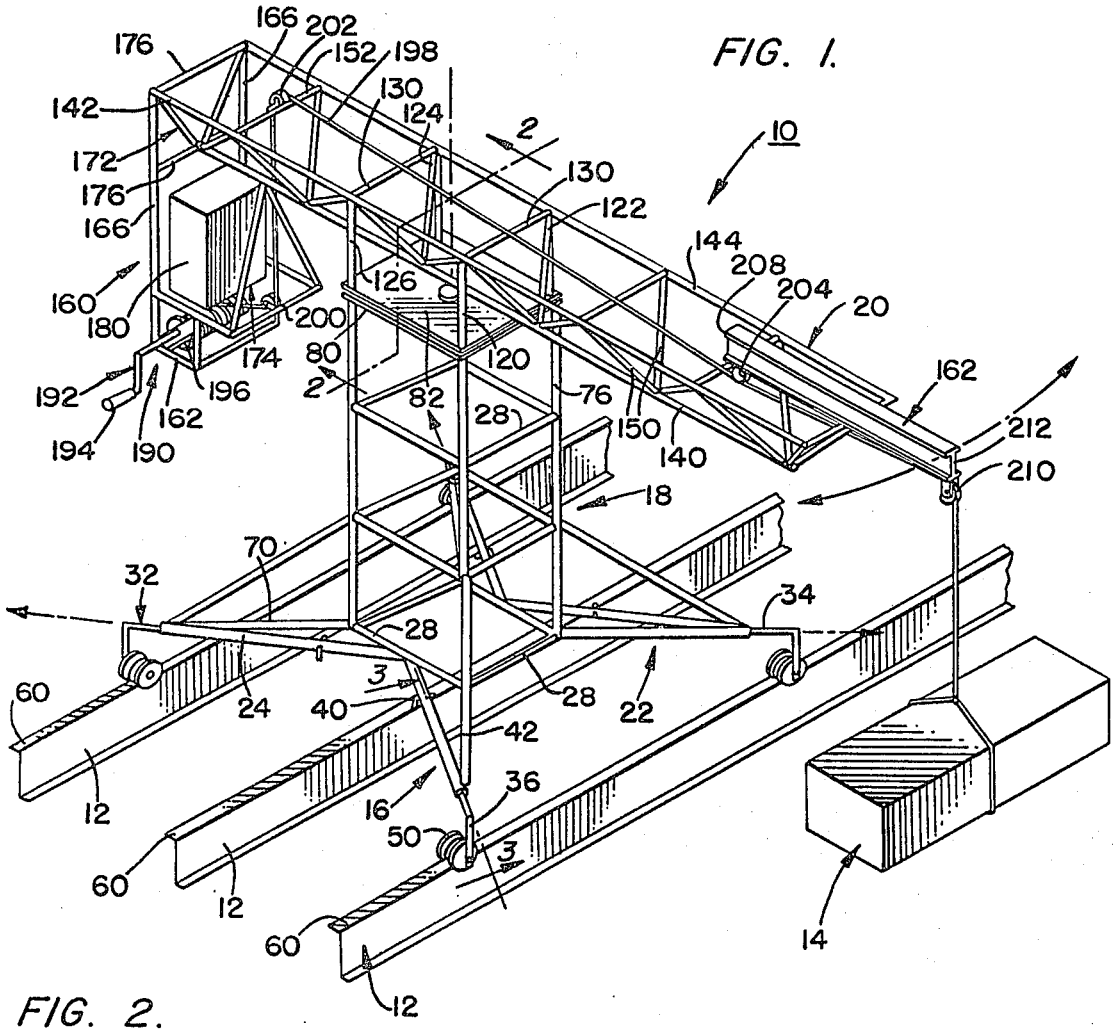
FIG. 1 is a perspective of a panel locator embodying the teachings of the present invention.
Figure 2:
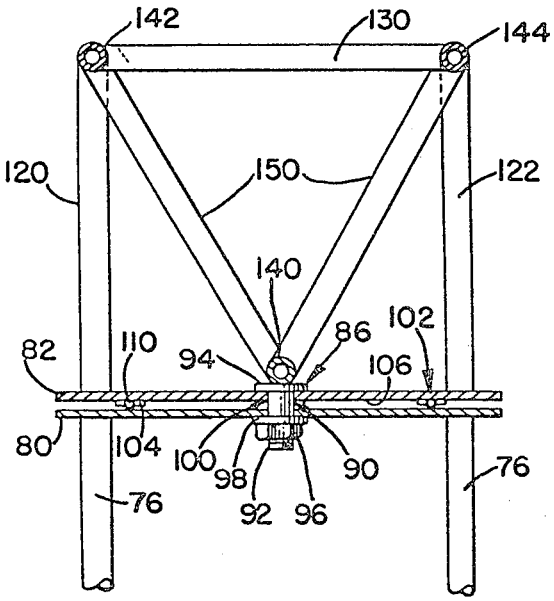
FIG. 2 is a view taken along line 2—2 of FIG. 1.

Shown in FIG. 1 is a first form of a panel locator embodying the teachings of the present invention. The locator is denoted by the reference numeral 10, and rests on and rides over roof purlins 12 to move panel bundles 14 from place to place during the roof construction. As above-discussed, the bundles are moved by the locator 10 over a ROLL RUNNER platform.

The locator 10 includes a base structure 16 which supports a tower structure 18 and a boom structure 20. The base 16 includes a plurality of legs 22 with each leg having a sleeve 24 attached at one end thereof to a cross piece 28 of the tower structure and extending outwardly therefrom at an angle thereto.

An L-shaped angle piece 32 has a long leg 34 telescopingly received in a sleeve 24 and a short leg 36 oriented to depend downwardly therefrom toward the purlins. A locking pin 40 is received in aligned holes 42 and 44 of the sleeve and the angle piece, respectively, to lock the angle piece in position on the sleeve. Various positions of the angle piece in the sleeve are used to accommodate various purlin spacings.

Figure 3:
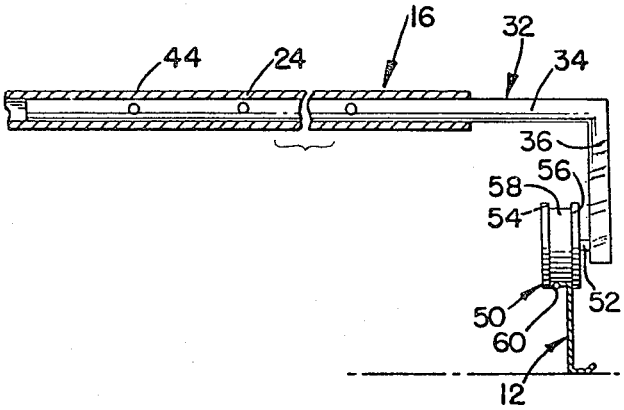
FIG. 3 is a view taken along line 3—3 of FIG. 1.

A wheel 50 is mounted on each angle piece short leg by an axle 52 and includes flanges 54 and 56 in the central section 58. The wheel is sized to ride securely on a purlin top flange 60 as best shown in FIG. 3.

Leg supports 70 connect the sleeves to the tower section to add security to the base section.

The tower section includes a plurality of cross pieces 28 and vertical pieces 76 and rises vertically upward from the base, as best shown in FIG. 1.

A platform is mounted on top of the tower section and includes a planar mounting plate 80 securely fixed to the tower and a planar carriage plate 82 rotatably mounted on the mounting plate. A pivot 86 connects the carriage and mounting plate and includes a bolt 90 having external threads 92 on one end thereof and a planar cap 94 on the other end thereof. A nut 96 is secured to the bolt and washers 98 and 100 are carried on the nut. The washers permit relative rotation between the plates without causing the nut to loosen.

A bearing means 102 is interposed between the plates and includes an annular cage 104 mounted on undersurface 106 of the plate 82 and housing a plurality of balls 110 which permit easy relative rotation of the plates.

Vertical supports 120, 122, 124 and 126 are mounted on the corners of the carriage plate 82, and first cross ties 130 are mounted on the supports 120, 122, 124 and 126.

The boom section includes a base leg 140 extending longitudinally of the section and longitudinal support members 142 and 144 connected to the base leg by support bars 150, with cross ties 152 adding further support to the boom section.

A cage 160 is located at one end of the boom, and a lifting beam 162 is located at the other end of the boom.

The cage 160 includes vertical bars 166 connected to the longitudinal bars 142 and 144 to depend therefrom, and horizontal bars 168 connected to the vertical bars 166 to be in spaced parallelism with the longitudinal bars 142 and 144. First and second triangular support sections 172 and 174 and cross tie 176 further support the cage.

A counterweight 180 is supported within the cage, and a windlass 190 is mounted on the cage. The windlass includes a crank 192 having a handle 194 thereon and which is connected to a spool 196 around which cable 198 is wound and unwound during lifting and lowering operations.

The cable 198 is trained around pulleys 200 and 202 mounted on the cage and boom, respectively. The cable extends longitudinally of the boom, over the top of the boom, and is guided by a sheave 204 mounted on the lower surface of the lifting beam 162 near a proximal end 208 thereof. The cable is trained around pulley 210 on a distal end 212 of the beam 162 and depends downwardly therefrom to suspend a bundle 14 as shown in FIG. 1.

The beam 162 is securely mounted at the proximal end thereof on the boom and at an intermediate point thereon.

A bundle 14 is attached to the cable and then lifted using the windlass. The locator 10 is then moved along the purlins and the boom is rotated to move the bundle to the desired location. The windlass is operated to lower the bundle, and that bundle is then disconnected from the cable.

The base, tower and boom sections can be separated, so the locator can be knocked down for storage and shipment.

Figure 4:
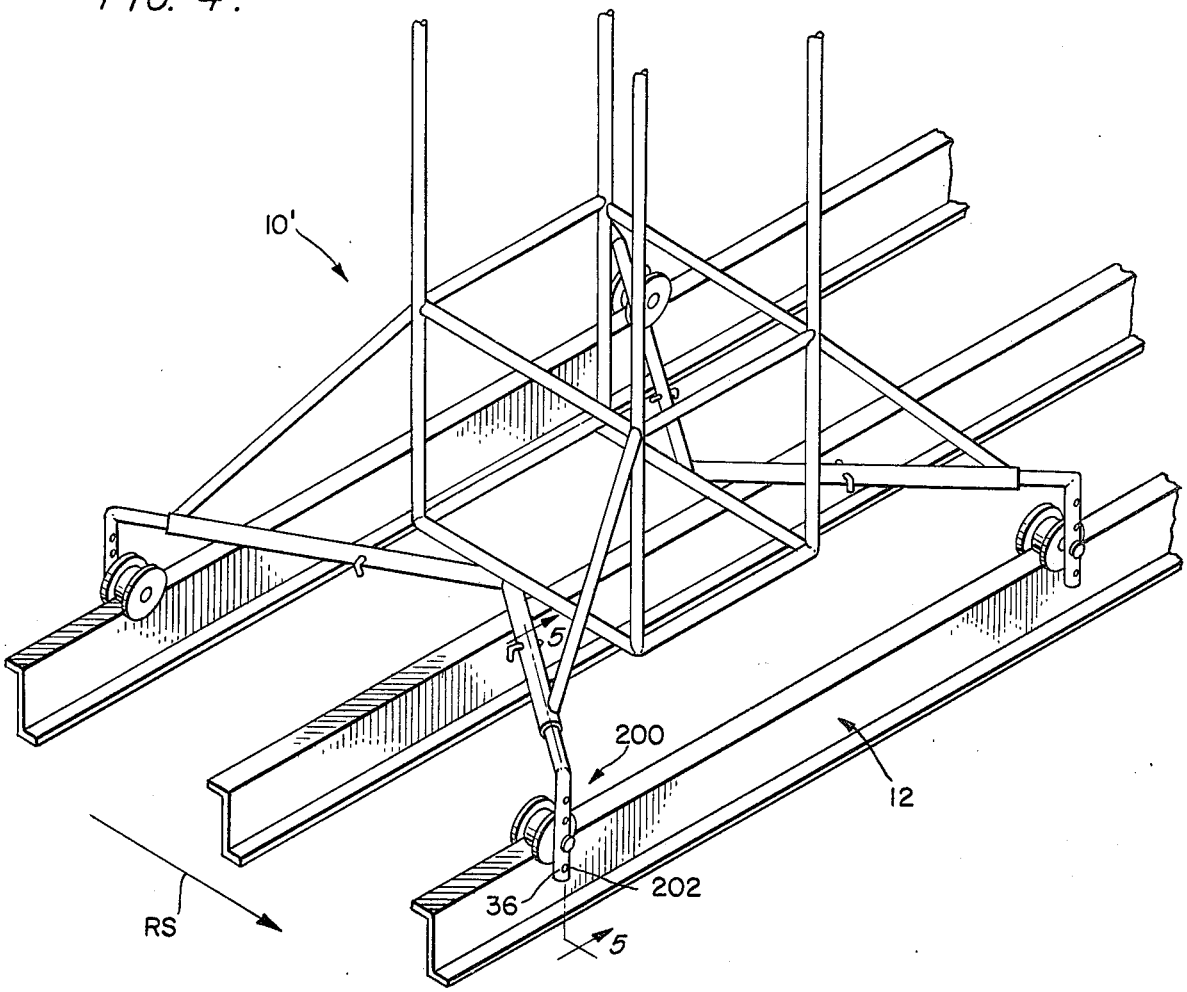
FIG. 4 is a perspective of a panel locator having leveling means in accordance with the teachings of the present invention.
Figure 5:
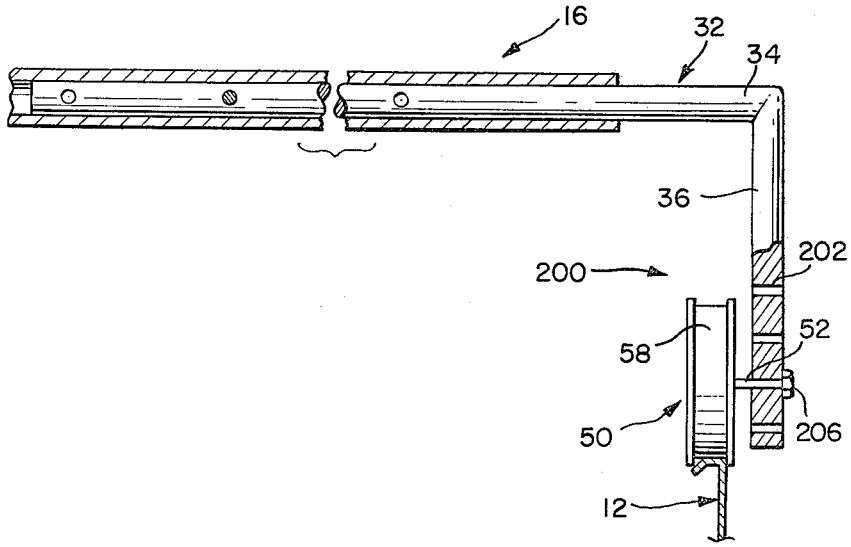
FIG. 5 is a view taken along line 5—5 of FIG. 4.

Shown in FIGS. 4 and 5 is a panel locator 10' which is similar to panel locator 10, but includes a leveling means 200 for accommodating roof pitch so that the locator 10' has the capability of maintaining a level orientation on a sloped roof. Roof slope is indicated in FIG. 4 by the arrow RS. The leveling means includes a plurality of passages 202 defined in short leg 36 to be spaced from each other along the vertical dimension of that leg with respect to the FIG. 4 orientation of the locator 10'.

The wheel axle 52 includes a fastener 206 on the end thereof which is remote from the wheel 50 and extends through the passages so the short leg is interposed between the wheel and the fastener. Any suitable fastener can be used without departing from the scope of this disclosure.

By selecting appropriate passages, the wheels 50 can be adjusted to account for roof slope RS to maintain the locator 10' in a level orientation.

Figure 6:
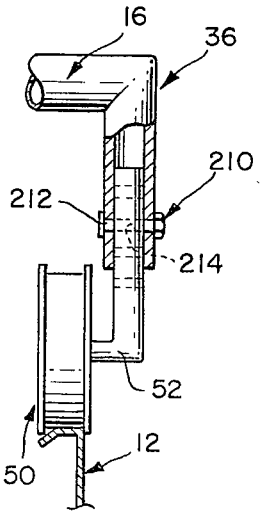
FIG. 6 is an elevation view similar to FIG. 5 showing telescoping sections for a leveling means.

Alternatively, as shown in FIG. 6, the short leg 36 can have a plurality of telescoping sections coupled together by pins 210, or the like. The telescoping sections are moved with respect to each other to account for the roof slope, as above discussed, and the pins are inserted through aligned openings 212 and 214 in the telescoping sections whereby the length of each of the short legs is adjustable.

Figure 7:
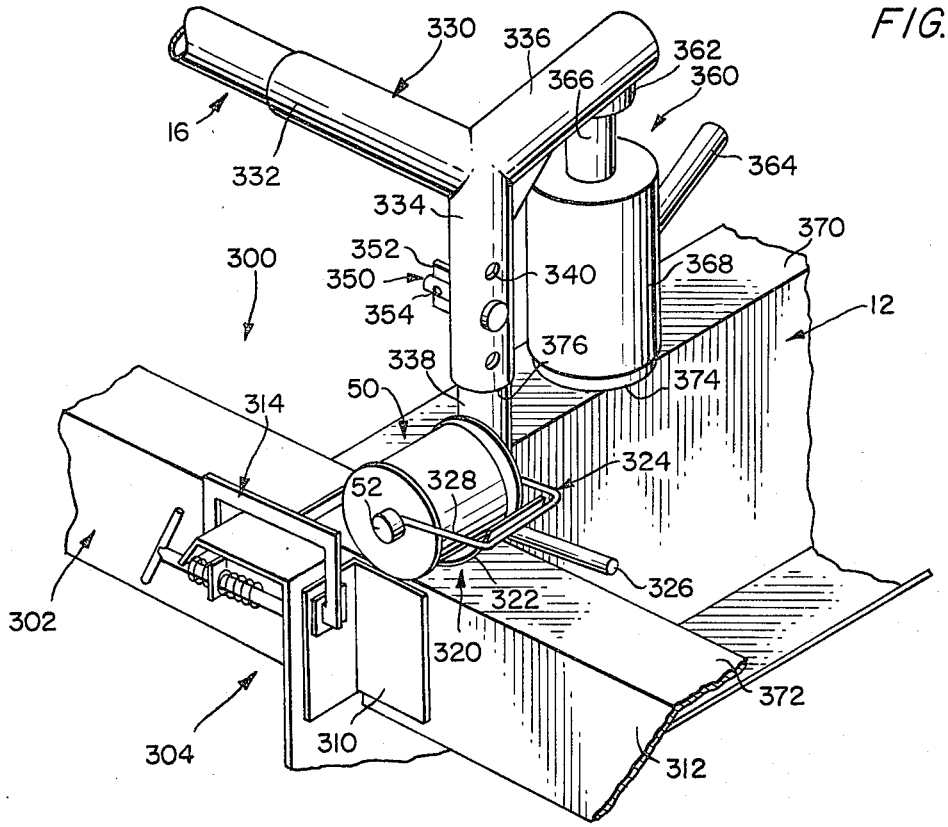
FIG. 7 is a perspective of a transfer means and a braking means used with the panel locator.
Figure 8:
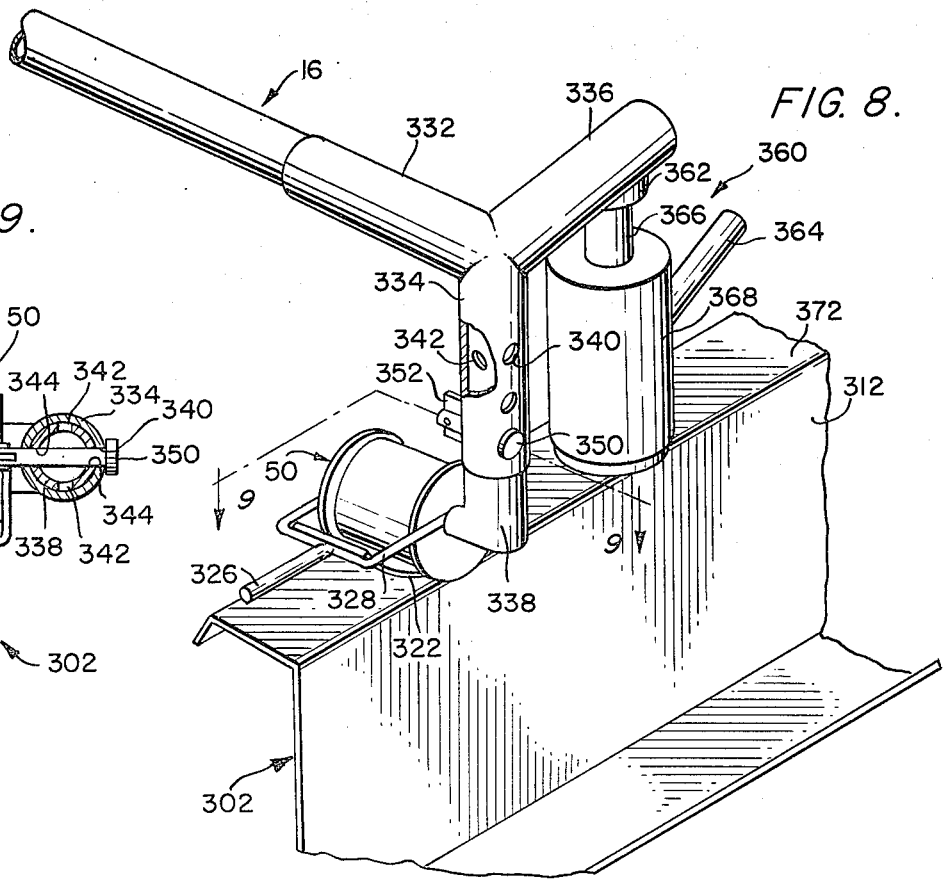
FIG. 8 is a perspective showing the panel locator wheel rotated 90° from the FIG. 7 position.
Figure 9:
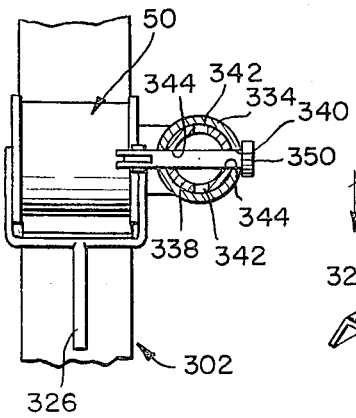
FIG. 9 is a view taken along line 9—9 of FIG. 8.

Shown in FIGS. 7–9 is a means for providing further mobility to the above-discussed panel locator.

As shown in FIG. 7, a transfer track 300 includes an angle-type rail 302 having a quick connect/disconnect means 304 mounted thereon. The rail 302 includes cutout means for accommodating purlins 12 and is oriented at an angle, preferably a right angle, with respect to such purlins. The means 304 includes an angle bracket 310 securely affixed to face 312 of the rail 302 and a coupling means, such as C-clamp 314. The coupling means releasably attaches the rail to the purlin via the angle bracket. There may be a plurality of means 304 if so desired, and one means 304 can be associated with each purlin intersected by the rail 302. Once the transfer track is no longer required, it can be easily removed. As mentioned above, the rail can extend from up to down slope along the roof and can further be used to help the panel locator accommodate sloped roofs.

Furthermore, a plurality of rails can be included, with each rail having an angle bracket affixed thereto in a manner similar to that shown for bracket 310 at both ends of such rail. The rails will be placed between purlins and each rail spans the distance between adjacent purlins. The rails will be each coupled to the purlins to be aligned, with each rail being coupled at each end thereof to purlins by coupling means similar to means 304. Thus, two aligned adjacent rails will be coupled to a purlin located between such rails to assume a form similar to that shown for rail 302 in FIG. 7.

A brake 320 is mounted on wheel 50, and includes an arcuate jamming plate 322 mounted on a frame 324. The frame 324 includes a handle 326 and legs 328 pivotably coupled to wheel axle 52. The brake 320 is hand-operated, but other forms of the brake can be used without departing from the scope of this disclosure. The brake also controls downslope movement of the panel locator, as well as sets the locator during a direction change thereof. The arcuate nature of the jamming plate permits controlled movement of the panel locator.

A sleeve 330 attaches frame 16 to the wheel 50, and includes legs 332, 334 and 336, with leg 332 receiving frame 16 and leg 334 receiving axle mount 338 to which the wheel 50 is connected.

The leg 334 includes a plurality of holes 340 which are spaced apart longitudinally of the leg in a manner similar to the holes 202 shown in FIG. 5. The axle mount 338 includes a plurality of first holes 342 (best shown in FIG. 8) and a plurality of holes 334 oriented at an angle, preferably a right angle, with respect to the first holes and located to be co-level with such first holes, as best shown in FIG. 9.

A pin 350 is inserted through holes 340 and either holes 342 (see FIG. 7) or holes 344 (see FIGS. 8 and 9) to attach the wheel to the frame via the sleeve 330 in either the purlin following orientation shown in FIG. 7 or the transfer track following orientation shown in FIG. 8. The pin 350 includes a cross-piece 352 releasably attached thereto by a pin 354 so that the pin can be withdrawn from the holes and, once inserted, will remain in place.

A jack 360 is attached to sleeve leg 336 and elevates the panel locator while a direction movement is being executed. The jack also helps compensate for roof slope, or other wheel adjustments, as needed. The jack includes a mount 362 attached to the leg 336 and a strut 364 attached to the panel locate frame 16, both attached to a lifting cylinder via actuating rod 366 and cylinder housing 368, respectively.

The cylinder is normally spaced from the purlin top surface 370 or top surface 372 of the transfer track rail 302 to permit unrestricted movement of the panel locator. However, actuation of the fluid cylinder forces cylinder housing end 374 against either top surface 370 or 372 and lifts the panel locator, and hence the wheel associated with the jack, from the purlin or the transfer track rail. The elevated wheel can then be rotated into the desired orientation, or moved to the desired spacing from leg bottom rim 376.

The jack is permanently affixed to the locator frame. The frame legs shown in FIGS. 1 and 4 can also be modified to include the sleeve 330, jack 360 and brake 320, if so desired. Alternatively, the jack can be connected directly to the frame 16 of the FIGS. 1 and/or 4 embodiments, and suitable holes defined in the short legs 36 thereof. The brake 320 can be included in either of these embodiments also without modifying the wheels and associated equipment shown in FIGS. 1 and 4. Thus, the transfer track 300 and slope accommodating brakes and jack can be associated with any or all of the wheels on each and any of the panel locators disclosed herein.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A knockdown panel locator comprising:

a base section which includes wheels rollably mounted on said base for rolling on roof purlins in a first direction and mounting legs mounting said wheels on said base;

transfer tracks extending in a second direction, means for attaching said transfer tracks to said purlins, direction change means for changing the direction of said wheels from said first direction to said second direction to permit movement of said panel locator along said transfer tracks, jack means for elevating said wheels to facilitate movement between said purlins and transfer tracks a tower section mounted on said base and extending upwardly therefrom;

a boom section rotatably mounted on said tower section to be elevated above a roof, said boom section including an elongated body having a cage at one end thereof and a panel bundle supporting means on another end thereof;

leveling means for maintaining the panel locator level on a sloping roof; and lifting means on said boom section for lifting panel bundles off a roof.

2. The panel locator defined in claim 1 wherein said base section legs include telescoping sections.

3. The panel locator defined in claim 1 wherein said tower section includes a mounting plate.

4. The panel locator defined in claim 3 wherein said boom section includes a carriage plate pivotally mounted on said mounting plate.

5. The panel locator defined in claim 4 wherein said boom section further includes roller bearings interposed between said carriage and mounting plates.

6. The panel locator defined in claim 1 wherein said boom section includes a lifting beam mounted on said boom section body another end.

7. The panel locator defined in claim 6 wherein said lifting means includes a windlass.

8. The panel locator defined in claim 7 wherein said boom section further includes a counterweight mounted on said one end.

9. The panel locator defined in claim 1 wherein said leveling means includes a plurality of sections telescopingly engaged with each other forming a portion of each of said mounting legs.

10. The panel locator defined in claim 1 wherein said leveling means includes a plurality of passages defined in each of said mounting legs.

11. The panel locator defined in claim 1 further including a brake means associated with one of said wheels.

12. The panel locator defined in claim 10 wherein said passages include first and second passages oriented at an angle with respect to each other.

13. The panel locator defined in claim 1 further including a sleeve mounting each wheel on said base.

14. The panel locator defined in claim 1 wherein said transfer track includes coupling means for releasably coupling said transfer track to a purlin, and said coupling means including a bracket attached to said transfer track and a clamp releasably attaching said bracket to a purlin.

15. The panel locator defined in claim 11 wherein said brake means includes a frame pivotably mounted on a wheel, a handle mounted on said frame and a jamming plate mounted on said frame.

16. The panel locator defined in claim 15 wherein said jamming plate is arcuate and is adapted to be inserted between a wheel and a surface supporting such wheel.

* * * * *